United States Patent [19]

Bartman et al.

[11] Patent Number: 5,046,146

[45] Date of Patent: Sep. 3, 1991

[54] FUSER SYSTEM UTILIZING A RECIPROCATING PRESSURE WEB

[75] Inventors: David A. Bartman, Rochester; Emilio J. Giuseppetti, Webster; Donald L. Pease, Honeoye, all of N.Y.

[73] Assignee: Xerox Corporation, Stamford, Conn.

[21] Appl. No.: 609,317

[22] Filed: Nov. 5, 1990

[51] Int. Cl.[5] ..... G03G 15/20

[52] U.S. Cl. ..... 219/216; 355/290; 219/469

[58] Field of Search ..... 219/216, 469, 470, 471; 355/289, 290, 295

[56] References Cited

U.S. PATENT DOCUMENTS

| | | | |
|---|---|---|---|
| 3,632,984 | 1/1972 | Brownscombe | 219/469 |
| 3,718,116 | 2/1973 | Thettu | 118/266 |
| 4,064,933 | 12/1977 | Schuman | 219/216 |
| 4,112,280 | 9/1978 | Salsich | 219/216 |
| 4,689,471 | 8/1987 | Pirwitz et al. | 219/216 |
| 4,822,978 | 4/1989 | Morris | 219/216 |
| 4,860,047 | 8/1989 | Pirwitz | 355/290 |

*Primary Examiner*—Teresa J. Walberg

[57] ABSTRACT

A low mass fuser roll fusing system incorporates a thin web member to maintain copy sheets in biased contact with a fuser roll during a fusing operation. The copy sheets are introduced to the fusing area at an entrance nip formed by a biasing assembly. The lead edge of the copy sheet is introduced into the entrance nip by a reciprocating mecahnism which moves, the web member and the copy sheet supported thereon into the entrance nip. The web member motion is then stopped and the copy sheet progresses through the fusing cycle until the copy sheet emerges from the fusing area, at which time the web member is returned to its original position.

5 Claims, 3 Drawing Sheets

FUSER SYSTEM UTILIZING A RECIPROCATING PRESSURE WEB

BACKGROUND OF THE INVENTION AND INFORMATION DISCLOSURE STATEMENT

This invention relates generally to an electrophotographic copying apparatus, and more particularly, to the heat and pressure fixing of toner images formed on a copy substrate by direct contact with a heated fusing member.

In the process of xerography, a light image of an original to be copied is typically recorded in the form of a latent electrostatic image upon a photosensitive member with subsequent development of the latent image by the application of marking particles commonly referred to as toner. The visual toner image is typically transferred from the member to a copy substrate, such as a sheet of plain paper, with subsequent affixing of the image by one of several fusing techniques. A preferred fusing system applies both heat and pressure to the copy substrate.

In one prior art fusing system, a fuser roll is used which has an outer surface or covering of polytetrafluoroethylene or silicone rubber, the former being known by the trade name Teflon, to which a release agent such as silicone oil is applied, the thickness of the Teflon being on the order of several mils and the thickness of the oil being less than 1 micron. Silicone based oils which possess a relatively low surface energy, have been found to be materials that are suitable for use in a heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface. A fuser roll construction of this type is disclosed in U.S. Pat. No. 3,718,116 assigned to Xerox Corporation.

While heat and pressure fusers of the type discussed above are desirable because of their thermal efficiency, they possess some disadvantages because of their mechanical complexity, cost, long warm-up times and paper wrinkling. A second type of system is known in the prior art which reduces or eliminates these undesirable characteristics. This system utilizes a relatively low mass fuser roll member of the type disclosed, for example, in U.S. Pat. No. 4,689,471 assigned to Xerox Corporation. As disclosed in this patent, a low mass heated fuser roll cooperates with an elongated web member comprising a woven fabric to form an extended fusing area. One end of the pressure web is fixed while the other end is biased into pressure engagement with the fuser roll to form an entrance nip. The pressure web is an enabling feature of this type of system but its effectiveness depends upon several factors such as the type of copy substrate media being used and relative humidity conditions. As an example, certain types of copy media are as subject to stalling or jamming on the leading edge entrance of the fuser entrance nip. The pressure and location of the biasing means if therefore of critical importance. One improvement is disclosed in U.S. Pat. No. 4,860,047 in which a feed roller is introduced at the entrance nip which cooperates with the fuser roll to improve entrance of the copy sheet into the fusing area.

The present invention is directed to a still further improved system whereby a copy sheet entry into the fusing area is effected by causing the fuser web member to move in the direction of copy sheet movement at the critical moment of entry carrying the leading edge of the copy sheet into the entrance nip area. More particularly the invention relates.

DETAILED DESCRIPTION OF THE INVENTION

Figure 1:
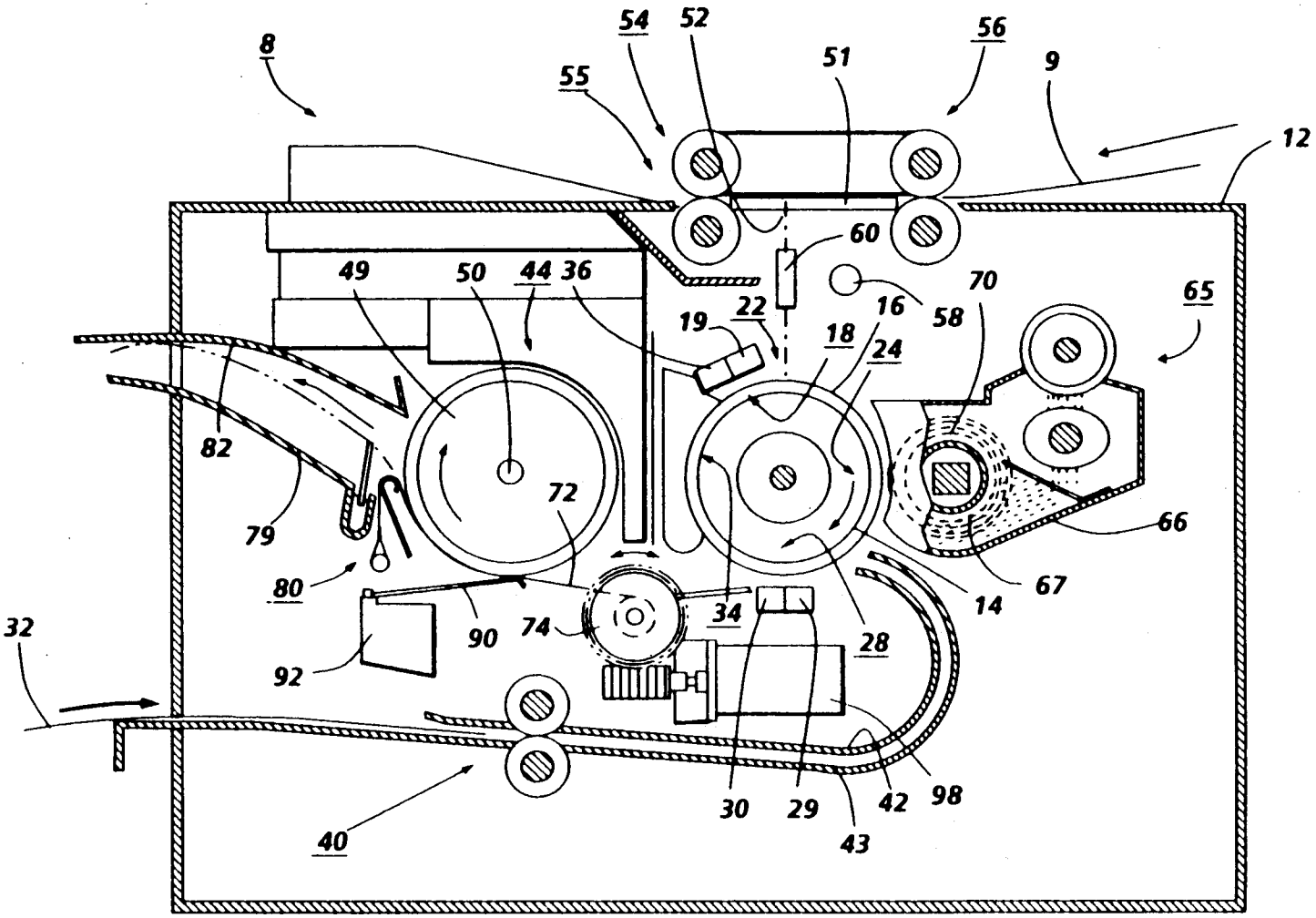
FIG. 1 is a side view in section of a reproduction machine having the improved fuser system of the present invention.

Referring to FIG. 1 of the drawings there is shown a xerographic type reproduction machine 8 incorporating the present invention. Machine 8 has a suitable frame 12 on which the machine xerographic components are operatively supported. Briefly, as will be familiar to those skilled in the xerographic printing and copying arts, the xerographic components of the machine include a charge retentive recording member, shown here in the form a of a rotatable photoreceptor 14. In the exemplary arrangement shown, photoreceptor 14 comprises a drum having a photoconductive surface 16. Other photoreceptor types such as belt, web, etc. may instead be employed. Operatively disposed about the periphery of photoreceptor 14 are a charging station 18 with charge corotron 19 for placing a uniform charge on the photoconductive surface 16 of photoreceptor 14, exposure station 22 where the previously charge photoconductive surface 16 is exposed to image rays of a document 9 being copied or reproduced to thereby form a latent electrostatic image on the charge retentive surface; development station 24 where the latent electrostatic image created on photoconductive surface 16 is developed by toner; combination transfer and detack station 28 with transfer corotron 29 detack corotron 30 for sequentially transferring the developed image to a suitable copy substrate material such as a copy sheet 32 brought forward in timed relation with the developed image on photoconductive surface 16 and lessening the forces of attraction between the copy substrate and the charge retentive member; cleaning station 34 and discharge corotron 36 for removing leftover developer from photoconductive surface 16 and neutralizing residual charges thereon.

A copy sheet 32 is brought forward to transfer station 28 by feed roll pair 40. Sheet guides 42, 43, serve to guide the sheet through an approximately 180 degree turn prior to the copy substrate reaching the transfer station 28. Following transfer, the sheet 28 is carried forward to a fusing station 44 where the toner image is contacted by fusing roll 49 forming one member of a heat and pressure fuser. Fusing roll 49 is heated by a suitable heater such as quartz lamp 50 disposed within the interior of roll 49. After fusing, the copy sheet 32 is discharged from the machine.

A transparent platen 50 supports the document 9 as the document is moved past a scan area 52 by a constant velocity type transport 54. As will be understood, scan area 52 is in effect a scan line extending across the width of platen 50 at a desired point along platen 50 where the document is scanned line by line as the document is moved along platen 50 by transport 54. Transport 54 has input and output document feed roll pairs 55, 56 respectively on each side of scan area 52 for moving document 9 across platen 50 at scan area 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 70 is disposed in a predetermined cooperative relation to the photoconductive surface 16 in developer housing 65, roll 70 serving to bring developer from sump 66 into developing relation with photoreceptor 14 to develop the latent electrostatic images formed on the photoconductive surface 16.

The fuser roll 49 comprises a thin-walled thermally conductive tube having a thin (i.e. approximately 0.005 inch (0.01 Centimeters)) coating of silicon rubber on the exterior surface thereof which contacts the toner images on the copy substrate to thereby affix the images to the substrate. A release agent management system, not shown, applies a thin layer of silicone oil to the surface of the fuser roll for the prevention of toner offset thereto as well as reducing the torque required to effect rotation of the fuser roll. In one operative embodiment of the fuser roll its diameter was 3.3 inches and had a length of 40 inches. This embodiment is typically used to fuse images on copy substrates that are 3 feet (0.91 meters) wide by 4 feet (1.22 meters) in length.

Figure 2:
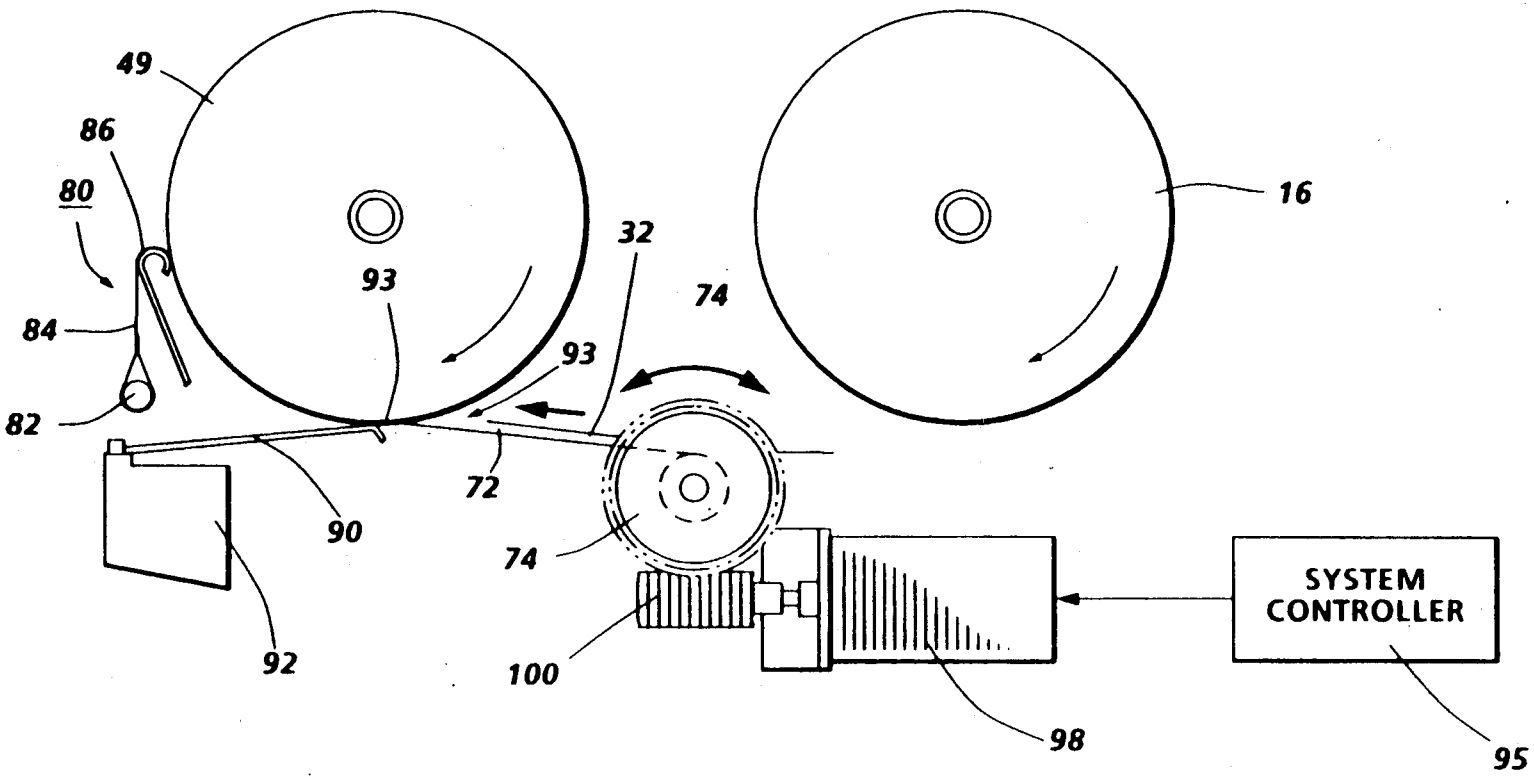
FIG. 2 is an enlarged view of a first embodiment of the fuser system shown in FIG. 1.

The fuser apparatus 44 also comprises a non-rotating, elongated pressure web member 72. As viewed in FIGS. 1 and 2, one end of web 72 is wrapped around reciprocating drive pulley 74. The opposite end of the web is biased into engagement with the fuser roll so that the fuser roll and the web cooperate to form an elongated nip 78 therebetween.

A pressure applying mechanism 80 creates a force between the roll and web so as to produce a frictional force therebetween that keeps the web in tension so it can provide suitable pressure to the surface of the fuser roll. Mechanism 80 encompasses a weighted rod 82 disposed in a loop 84 formed in web 72. A portion of the web intermediate the two ends thereof rides over a curved portion 86 of a web frame or support member 88. A biasing force is applied to the frame or support member 88 so that to thereby urge the web 72 into engagement with the fuser roll 49. The force, so applied, is just sufficient to keep the web biased against the roll in the fusing zone.

A blade member 90 has one end anchored in the frame structure 92 while its other end contacts the web at the nip area 93 to apply a load against the web and thereby cooperate with the pressure applying mechanism 80 to effect the required pressure in the nip for satisfactory operation. The area of contact between the web and the fuser roll forms the entrance to the nip area. The blade is preferably fabricated from thermally nonconductive material and is mounted such that in its free state it is flat and in its operative state the edge of the blade is deflected by the fuser roll to thereby cause it to function as a leaf spring, applying the aforementioned load against the web. Edge contact of the blade produces the highest possible pressure for a given force or lead the purpose of the blade is to control paper cockle caused by the rapid drying of high moisture content paper.

According to a first aspect of the invention, reciprocating pulley 74 is adapted to rotate in a counterclockwise direction when the leading edge of copy sheet 32 begins its entrance into nip area 93. Appropriate signals are generated from system controller 95 and sent to drive motor 98. Gear output shaft 100 cooperates with gear 102 to drive pulley 74 in the counterclockwise direction for a relatively short time duration. As the pulley rotates, web member 72, moving in the same direction as copy sheet 32, frictionally engages the copy sheet against the surface of fuser roll 49, carrying it into and just beyond the nip area. Weighted rod 80 descends slowly to maintain the biasing of web 72 to roller 49. The web member motion stops at that point and the copy sheet is moved along by fuser roll 49 rotation. The sheet progresses through the contact (fusing) area until it emerges from exit area 104. When the trailing edge clears exit area 104, controller 95 energizes motor 98 in a reverse drive causing drive roller 74 to rotate in a clockwise direction returning web member 72 to its original position.

Figure 3:
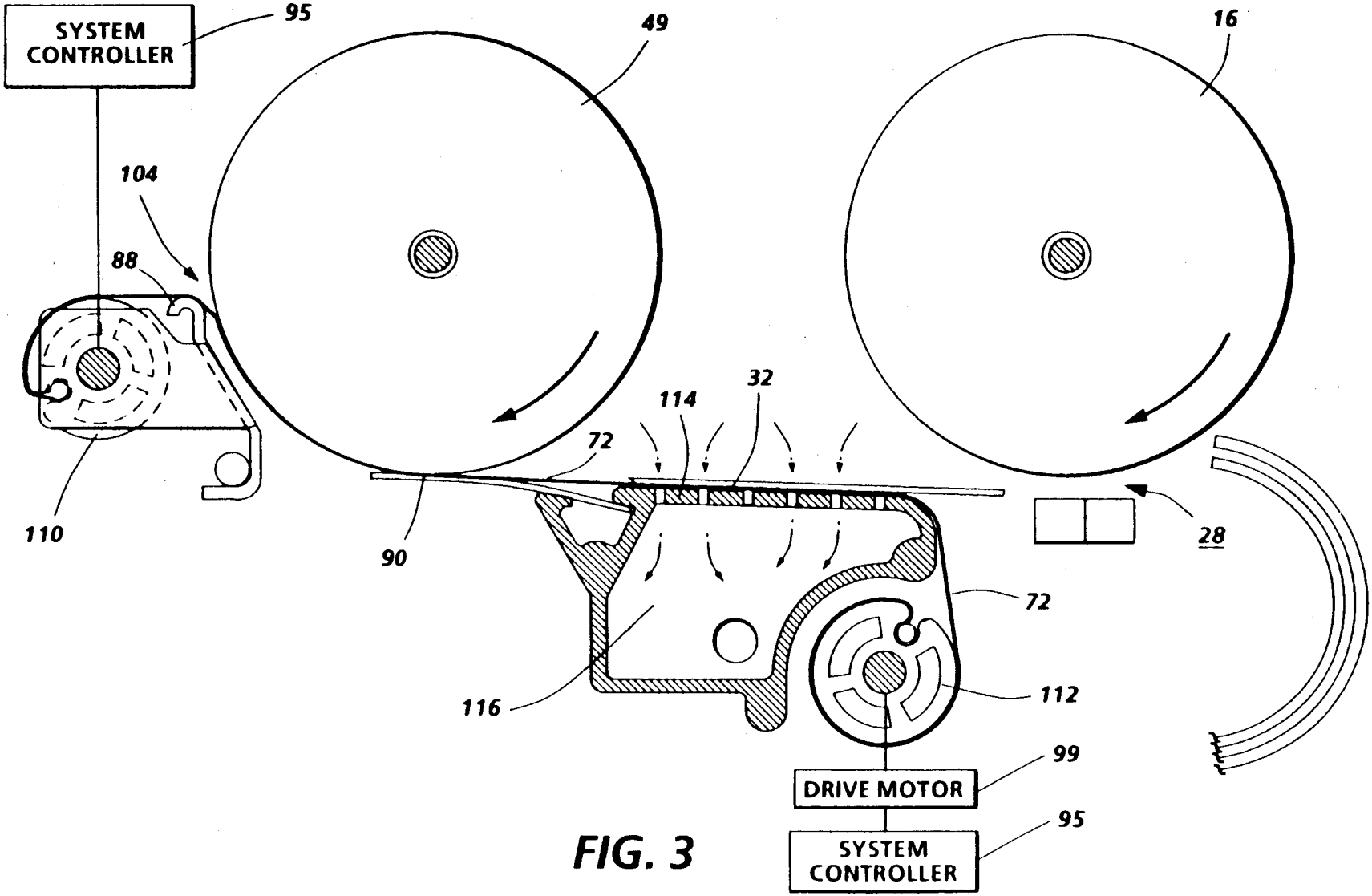
FIG. 3 is an enlarged view of a second embodiment of the fusing system of the present invention.

FIG. 3 shows a second embodiment of the invention where the web member 72 is reciprocated between a take-up roller 110 and a feed roller 112. One end of the web is wound around take-up roller 110; the web rides over curved portion of web frame 88. The web biasing force is again supplied by a blade member 90. The other end of web member 72 is wound around feed roller 112. The copy sheet is maintained in a flat condition as it approaches the nip area by conveying the sheet along the top perforated surface 114 of vacuum chamber 116. The copy sheet rides on web member 72 which is porous enough to permit a vacuum force to engage and hold the copy sheet flat. The copy sheet is engaged at the time it leaves detack area 28.

For this embodiment, system controller 95 is programmed to provide signals causing roller 110 to rotate in a counterclockwise direction by means of a drive motor 99. As the leading edge of copy sheet 32 leaves the detack area 28, web 72 is moved so as to move at the same speed as the copy sheet as it leaves the detack area. The web motion is stopped when the leading edge of the copy sheet is past the nip area, but the rest of the sheet maintains its flat orientation along the vacuum surface until the entire sheet passes through the nip entrance 93. When the trailing edge of the sheet emerges from exit area 104, the system controller sends a reverse drive signal to drive motor 99 reversing rotation of take up roller 112, and causing web member 72 to rewind to its original position.

While the invention has been described with reference to the structure disclosed, it will be appreciated that numerous changes and modifications are likely to occur to those skilled in the art, and it is intended to cover all changes and modifications which fall within the true spirit and scope of the invention.

What is claimed is:

1. A heat and pressure apparatus for fixing toner images to a copy substrate, said apparatus comprising:

a fuser roll;

a web member having an elongated surface area contacting said fuser roll to form a pressure fusing area therebetween through which a copy substrate carrying toner images is conveyed, said fusing area having an entrance nip area and an exit area, means for biasing said web member into contact with said fuser roll surface along said fusing area, and reciprocating means for moving said web member in the same direction as the copy substrate movement, and coincident with the leading edge of said copy sheet as it enters said nip area.

2. The apparatus of claim 1 wherein said reciprocating means is adapted to stop the motion of said web member once the copy sheet has entered the fusing area and to reverse the motion when the copy sheet clears said exit area.

3. The system of claim 2 wherein one end of said web member is entrained around a take-up roller and other end around a feed roller, and further including drive means for alternately driving said rollers in a time and relation with the passage of said copy sheet through the fusing area.

4. The system of claim 3 further including a vacuum means positioned beneath said web member along a pre-fusing path wherein the copy sheet riding on the web member surface in its approach to the nip area is maintained in a flat orientation.

5. The apparatus of claim 1 wherein one end of said web member is connected to a weighting mechanism and the other end is wound around a drive pulley; and further including drive means for driving said drive pulley in a time and relationship with the passage of said copy sheet through the fusing area.

* * * * *